US009930457B2

(12) United States Patent
Liu

(10) Patent No.: US 9,930,457 B2
(45) Date of Patent: Mar. 27, 2018

(54) HEARING DEVICE WITH DYNAMIC MIRROR SERVICE AND RELATED METHOD

(71) Applicant: GN Hearing A/S, Ballerup (DK)

(72) Inventor: Hong Liu, Ballerup (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 14/568,095

(22) Filed: Dec. 11, 2014

(65) Prior Publication Data

US 2016/0165365 A1 Jun. 9, 2016

(30) Foreign Application Priority Data

Dec. 5, 2014 (EP) ..... 14196520

(51) Int. Cl.
*H04R 25/00* (2006.01)

(52) U.S. Cl.
CPC ..... *H04R 25/554* (2013.01); *H04R 25/552* (2013.01); *H04R 2225/41* (2013.01); *H04R 2225/61* (2013.01); *H04R 2460/03* (2013.01)

(58) Field of Classification Search
CPC ..... H04R 25/554; H04R 25/552; H04R 2225/41; H04R 2225/61; H04R 2460/03
USPC ..... 381/315
See application file for complete search history.

(56) References Cited

U.S. PATENT DOCUMENTS

2006/0227976 A1 10/2006 Csermak et al.
2007/0269065 A1* 11/2007 Kilsgaard ..... H04R 25/554 381/315
2007/0291969 A1 12/2007 Tateno et al.
(Continued)

FOREIGN PATENT DOCUMENTS

WO WO 2007/039320 A2 4/2007
WO WO 2007/039320 A3 4/2007
(Continued)

OTHER PUBLICATIONS

Second Technical Examination dated Sep. 3, 2015, for related Danish Patent Application No. PA 2014 70764, 2 pages.
(Continued)

*Primary Examiner* — Sean H Nguyen
(74) *Attorney, Agent, or Firm* — Vista IP Law Group, LLP

(57) ABSTRACT

Disclosed is a method and a hearing device comprising a processing unit, a wireless transceiver connected to the processing unit, and a receiver connected to the processing unit for converting an output signal into an audio output signal, wherein the hearing device is configured to perform mirror service between the hearing device and another hearing device according to mirror service property, wherein the mirror service comprises transmitting mirror service packets with a packet format at a packet transmission rate; the mirror service packet comprising one or more hearing device operating parameters including a first hearing device operating parameter, wherein the processing unit is configured to obtain the first hearing device operating parameter, determine if a change criterion is fulfilled, wherein the change criterion is based on the first hearing device operating parameter, and change the mirror service property, if the change criterion is fulfilled.

30 Claims, 4 Drawing Sheets

(56) References Cited

U.S. PATENT DOCUMENTS

| | | | | |
|---|---|---|---|---|
| 2009/0067653 | A1* | 3/2009 | Meskens | H04R 25/552 381/315 |
| 2011/0150252 | A1* | 6/2011 | Solum | H04R 25/55 381/314 |
| 2013/0308804 | A1* | 11/2013 | Meskens | H04R 25/552 381/315 |

FOREIGN PATENT DOCUMENTS

| | | | |
|---|---|---|---|
| WO | WO 2009/144332 | A2 | 12/2009 |
| WO | WO 2009/153718 | A1 | 12/2009 |
| WO | WO 2013/123984 | A1 | 8/2013 |

OTHER PUBLICATIONS

Extended European Search Report dated May 27, 2015 for related European Application No. 14196520.2, 7 pages.
First Technical Examination dated Jun. 23, 2015 for related Danish Patent Application No. PA 2014 70764, 5 pages.

* cited by examiner

HEARING DEVICE WITH DYNAMIC MIRROR SERVICE AND RELATED METHOD

RELATED APPLICATION DATA

This application claims priority to and the benefit of Danish Patent Application No. PA 2014 70764 filed on Dec. 5, 2014, pending, and European Patent Application No. 14196520.2 filed on Dec. 5, 2014, pending. The entire disclosures of both of the above applications are expressly incorporated by reference herein.

FIELD

The present disclosure relates to a hearing device configured for wireless communication with another hearing device. In particular, the hearing device is configured to perform mirror service between the hearing device and another hearing device. The hearing device comprises a processing unit; a wireless transceiver connected to the processing unit; and a receiver connected to the processing unit for converting an output signal into an audio output signal.

BACKGROUND

Wireless communication between binaural hearing devices has increased with the developments within wireless technologies and user demands for increasingly advanced hearing devices. A hearing device has limited power resources given the demand for small hearing aids and the limited battery capacity of a hearing device battery.

Wireless communication requires a lot of power compared to the capacity of a hearing device battery.

SUMMARY

Accordingly, there is a need for power efficient transmission schemes in hearing devices. In particular, there is a need for reliable and power efficient communication between wirelessly connected binaural hearing devices.

Disclosed is a hearing device comprising a processing unit, a wireless transceiver connected to the processing unit, and a receiver connected to the processing unit for converting an output signal into an audio output signal. The hearing device is configured to perform mirror service between the hearing device and another hearing device according to mirror service properties. The mirror service comprises transmitting and/or receiving mirror service packets according to mirror service properties, e.g. with a packet format at a packet transmission rate. The mirror service packet comprises one or more hearing device operating parameters, e.g. including a first hearing device operating parameter. The processing unit is configured to obtain hearing device operating parameter(s), such as the first hearing device operating parameter and/or a second hearing device operating parameter. The processing unit may be configured to determine if a change criterion is fulfilled. The change criterion may be based on one or more hearing device operating parameters, such as the first hearing device operating parameter and/or the second hearing device operating parameter. The processing unit is configured to change or adapt the mirror service properties, e.g. if the change criterion is fulfilled. The mirror service properties may comprise a packet transmission rate and/or packet format.

Also disclosed is a method of performing mirror service between a first hearing device and a second hearing device. The method comprises transmitting and/or receiving mirror service packets according to mirror service properties, e.g. with a packet format at a packet transmission rate, the mirror service packet comprising one or more hearing device operating parameters, e.g. including a first hearing device operating parameter; and obtaining the first hearing device operating parameter. The method optionally comprises determining if a change criterion is fulfilled, e.g. wherein the change criterion is based on one or more hearing device operating parameters, such as the first hearing device operating parameter and/or a second hearing device operating parameter; and changing the mirror service properties, e.g. if the change criterion is fulfilled. The mirror service properties may comprise a packet transmission rate and/or packet format. The method optionally comprises transmitting and/or receiving mirror service packets according to the changed mirror service properties.

Further, a binaural hearing device system is disclosed. The binaural hearing device system comprises a first and a second hearing device, wherein the first and/or second hearing device is a hearing device presented in the present disclosure.

A hearing device with adaptive mirror service properties as disclosed herein enables power efficient communication between hearing devices and optimized or at least improved use of the limited power in the hearing device. At the same time, a sufficient signalling quality may be maintained, e.g. in order not to lose mirror service connection between two hearing devices. Thus, the hearing device as disclosed provides reduced risk of losing connectivity between two hearing devices in a binaural hearing device system.

A hearing device includes: a processing unit; a wireless transceiver connected to the processing unit; and a receiver connected to the processing unit for converting an output signal into an audio output signal; wherein the hearing device is configured to perform mirror service between the hearing device and another hearing device according to a mirror service property, wherein the mirror service comprises transmitting mirror service packets with a packet format at a packet transmission rate, at least one of the mirror service packets comprising one or more hearing device operating parameters including a first hearing device operating parameter, wherein the processing unit is configured to: obtain the first hearing device operating parameter; determine if a change criterion is fulfilled, wherein the change criterion is based on the first hearing device operating parameter; and change the mirror service property, if the change criterion is fulfilled.

Optionally, the mirror service property comprises a packet transmission rate and/or a packet format.

Optionally, the processing unit is configured to change the mirror service property by changing the packet transmission rate from a first packet transmission rate to a second packet transmission rate.

Optionally, the first packet transmission rate is larger than the second packet transmission rate.

Optionally, the second packet transmission rate is larger than the first packet transmission rate.

Optionally, the processing unit is configured to change the mirror service property by changing the packet format from a first packet format to a second packet format.

Optionally, the first hearing device operating parameter is indicative of a user interface activation, a mode shift, processing parameter(s) of the hearing device, or any combination of the foregoing.

Optionally, the processing parameter(s) of the hearing device comprises an environment identifier, a noise reduction parameter, a compressor parameter, a signal generator control, an auto phone detector, or any combination of the foregoing.

Optionally, the one or more hearing device operating parameters comprises a mirror service identifier.

Optionally, the first hearing device operating parameter comprises a processing parameter of the hearing device; and wherein the processing unit is configured to determine if the change criterion is fulfilled by determining whether a change in the processing parameter of the hearing device is larger than a threshold.

A method of performing mirror service between a first hearing device and a second hearing device, includes: transmitting mirror service packets according to a mirror service property with a packet format at a packet transmission rate, at least one of the mirror service packets comprising one or more hearing device operating parameters including a first hearing device operating parameter; obtaining the first hearing device operating parameter; determining if a change criterion is fulfilled, wherein the change criterion is based on the first hearing device operating parameter; changing the mirror service property, if the change criterion is fulfilled; and transmitting additional mirror service packets according to the changed mirror service property.

Optionally, the act of changing the mirror service property comprises changing a packet transmission rate and/or a packet format A binaural hearing device system includes the hearing device, and an additional hearing device.

Other features, embodiments, and advantageous will be described below in the detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
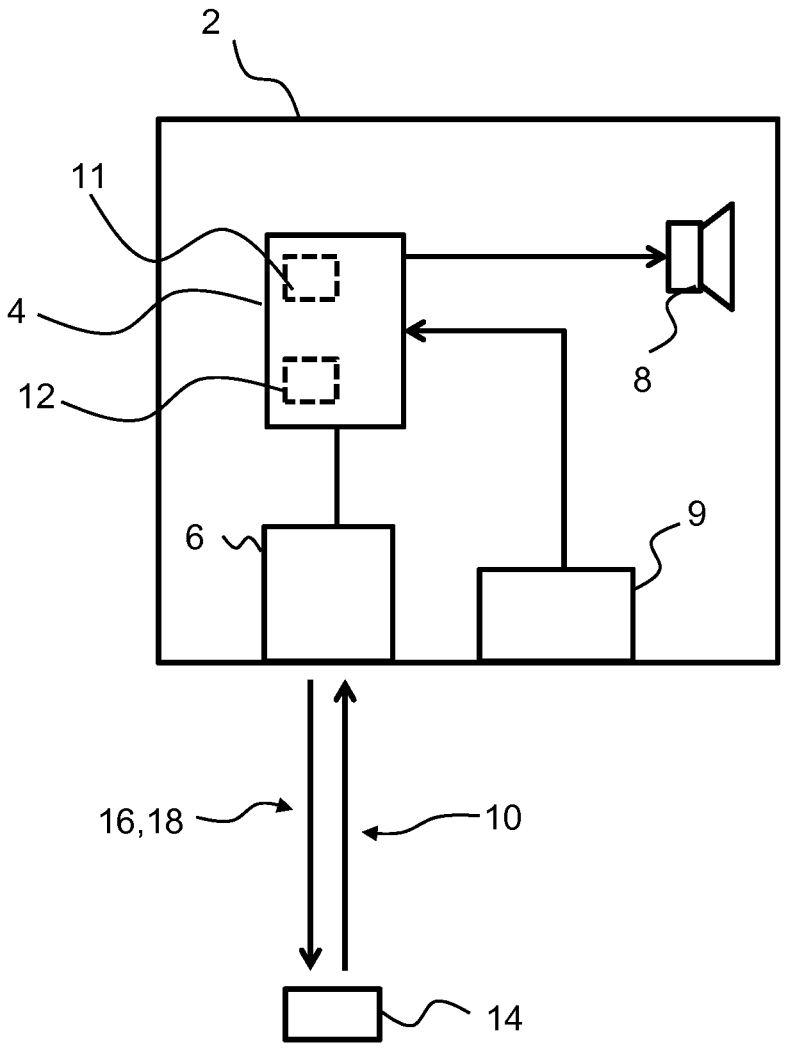
FIG. 1 schematically illustrates an exemplary hearing device

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

The hearing device is configured to perform mirror service between the hearing device and another hearing device. A mirror service is a transmission or communication channel in the wireless transmission between a first hearing device and a second hearing device of a binaural hearing system. The mirror service comprises transmitting mirror service packets with a packet format at a packet transmission rate between two hearing devices. A mirror service packet comprises one or more hearing device operating parameters, e.g. including a first hearing device operating parameter and/or a second hearing device operating parameter of the hearing device transmitting the mirror service packet. By means of the mirror service functionality, the first hearing device is informed about operating parameter(s) of the second hearing device and vice versa. Thereby, each of the two hearing devices are updated on and can adapt to the operating parameter(s) of the other hearing device. The mirror service may comprise ear-to-ear data service.

The hearing device may be a hearing aid, e.g. the processing unit may be configured for hearing loss compensation of a user's hearing loss.

The processing unit may be configured to determine if a change criterion is fulfilled. The change criterion may comprise one or more subcriteria, such as a first subcriterion and/or a second sub-criterion. The change criterion may be fulfilled if one or more subcriteria are fulfilled. For example, fulfillment of a first sub-criterion may be indicative of a possible reduction in the packet transmission rate. For example, fulfillment of a second sub-criterion may be indicative of a desired increase in the packet transmission rate, e.g. due to reduced signal quality. The processing unit may be configured to apply different sub-criteria of the change criterion depending on current mode of the hearing device and/or depending on current mirror service properties.

When the change criterion is fulfilled, the mirror service properties are changed. The mirror service properties may change when there are changes in one or more operating parameters, i.e. the change criterion may be fulfilled if a change in one or more of the operating parameters is determined/detected. The change criterion or a sub-criterion thereof may be based on the environment and/or settings of the hearing device and/or mode of the hearing device. The change criterion may be fulfilled when the hearing device operating parameters, e.g. data, between the two hearing devices changes from being stable, or there is no or only little change in the data, or the data is the same to that the data is not stable, or there are changes in the data. The change criterion may be fulfilled if the interface has been activated and/or if a mode shift has occurred.

By optimizing the mirror service and mirror service properties for communication between the hearing devices, power can be saved. Reducing the frequency with which mirror service is performed may save a lot of power or energy of the hearing device battery. Reducing the data size of the mirror service performed between the hearing device may also save some power or energy of the battery. At the same time an increase in packet transmission rate may ensure that the mirror service connection is not lost, which would require undesired reestablishment of the mirror service.

The hearing device and the other hearing device may have been paired, e.g. by pairing the identification or ID of the hearing device with the identification or ID of the other hearing device, before audio streaming is performed, and/or before transmission of data between the hearing devices is performed, and/or before the mirror service between the two hearing devices is performed.

The processing unit may be configured to change the mirror service properties by changing the packet transmission rate from a first packet transmission rate to a second packet transmission rate.

The first packet transmission rate may be larger than the second packet transmission rate, e.g. corresponding to the first mode (with first packet transmission rate) being an active or normal mode of the mirror service, and the second mode (with second packet transmission rate) being an idle mode, or inactive mode or sleep mode of the mirror service. The processing unit may be configured to change the packet transmission rate from a first packet transmission rate to a second packet transmission rate and/or vice versa when a default time period has passed without fulfillment of the change criterion, e.g. without any changes in one or more hearing device operating parameters. Alternatively or in combination, a subcriterion of the change criterion may comprise determining if a default time has passed without changes in one or more hearing device operating parameters. Thereby automatic switching to inactive mode is provided for.

The first packet transmission rate may for example be in the range from 5 packets/s to 20 packets/s, such as between 10 packets/s and 15 packets/s. Exemplary first packet transmission rates may be about 12.5 packets/s (corresponding to a time period of 80 ms between consecutive mirror service packets) or about 13.5 packets/s (corresponding to a time period of 74 ms between consecutive mirror service packets). The first packet transmission rate may correspond to a first mode, such as a normal mode or active mode of the mirror service transmission.

The second packet transmission rate may for example be in the range from 0.1 packets/s to 4 packets/s, such as between 0.3 packets/s and 2 packets/s. Exemplary second packet transmission rates may be about 0.5 packets/s (corresponding to a time period of 2 s between consecutive mirror service packets) or about 1 packets/s (corresponding to a time period of 1 s between consecutive mirror service packets). The second packet transmission rate may correspond to a second mode, such as an idle mode, or inactive mode or sleep mode of the mirror service. The second packet transmission rate may be used when there is no or only rare changes in the packet format or content of the transmitted packets, such that the mirror service transmission sends data less often, when the data does not change much.

The second packet transmission rate may be larger than the first packet transmission rate. This may correspond to changing the mode of the mirror service from a first mode being inactive/idle/sleep mode to a second mode being active/normal mode. In such case or in general, the first packet transmission rate may for example be in the range from 0.1 packets/s to 4 packets/s, such as between 0.3 packets/s and 2 packets/s. Exemplary first packet transmission rates may be about 0.5 packets/s (corresponding to a time period of 2 s between consecutive mirror service packets) or about 1 packets/s (corresponding to a time period of 1 s between consecutive mirror service packets). The first packet transmission rate may correspond to a first mode, such as an idle mode, or inactive mode or sleep mode of the mirror service. The first packet transmission rate may be used when there is no or only rare changes in the packet format or content of the transmitted packets, such that the mirror service transmission sends data less often, when the data does not change much. In such case or in general, the second packet transmission rate may for example be in the range from 5 packets/s to 20 packets/s, such as between 10 packets/s and 15 packets/s. Exemplary second packet transmission rates may be about 12.5 packets/s (corresponding to a time period of 80 ms between consecutive mirror service packets) or about 13.5 packets/s (corresponding to a time period of 74 ms between consecutive mirror service packets). The second packet transmission rate may correspond to a second mode, such as a normal mode or active mode of the mirror service transmission.

The first hearing device operating parameter may be indicative of one or more of user interface activation, mode shift, and/or processing parameter(s) of the hearing device. The first hearing device operating parameter may be indicative of hearing device identifier or other identifier that enables the other hearing device to maintain a mirror service connection. The second and/or a third hearing device operating parameter may be indicative of one or more of user interface activation, mode shift, and/or processing parameter(s) of the hearing device. User interface activation may comprise the user pushing a button on the hearing device, the user changing the volume control on the hearing device, the user actively or physically changing the mode of the hearing device, or the user changing anything on the hearing device which is user controlled. Mode shift of the hearing device may include that the hearing device automatically changes the hearing device mode, for example when the user moves from a noisy environment to a quiet environment. Hearing device mode shift may include that the user changes the mode, for example when the user moves from one type of environment to another type of environment. Processing parameters may comprise algorithmic parameters, automatic mode shift etc.

The processing parameter(s) of the hearing device may comprise one or more of environment identifier; noise reduction parameter; compressor parameter; signal generator control; and/or auto phone detector. The environment identifier may be output from an environment classifier of the hearing device. The noise reduction parameter may comprise fine tuning, filter coefficients etc. The compressor parameter may be indicative of a gain, such as a gain selected for the specific hearing compensation of the user of the hearing device. The signal generator control may comprise tinnitus sound generation (TSG) for tinnitus relief. The signal generator may comprise noise and/or feedback cancellation, occlusion cancellation etc.

The one or more hearing device operating parameters may comprise a mirror service identifier or indicator, e.g. as a part of the mirror service packets and/or in audio packet(s) of an audio stream received with the transceiver. The audio stream may be an ear-to-ear (E2E) audio stream, thus a mirror service indicator or flag may be present in the ear-to-ear audio stream in addition to the audio data. The mirror service indicator or flag may be a 1 bit data. Thus, the mirror service may utilize this channel to indicate which mirror mode the respective hearing device should use.

The audio stream may be a transmission between the two hearing devices, e.g. via an accessory device such as a smart phone, a mobile phone, a computer, a tablet etc. The audio stream may be transmitted wirelessly by 2.4 gigahertz Bluetooth connectivity between the two hearing devices, i.e. the binaural hearing devices, or between one or both hearing devices and an accessory device, such as a smart phone. The hearing devices may stream directly via the Bluetooth connectivity, or through a secondary streaming device, such as a neck- or pocket-worn streaming device, whereby this Bluetooth enabled secondary streaming device then streams wirelessly to the hearing device, and this may then be limited to work only over a short distance.

To change the mirror service properties may comprise changing the packet format from a first packet format to a second packet format, e.g. different from the first packet format. The packet format may be determined or defined by its size and/or configuration. The packet format may comprise a size and/or content of packet. A packet may comprise one or more fields or segments including a first field and/or a second field. The packet format may comprise a size identifier and/or a packet format identifier. For example a first field in the packet may comprise a header, where the header may comprise an identifier, e.g. an identifier of the hearing device and/or of the other hearing device. The header may comprise a time stamp and/or packet size. A second field of the packet may comprise a packet format identifier, e.g. indicative of the packet type and/or content of the packet, and/or a size identifier. A third field of the packet may comprise a time stamp and/or data of one or more hearing device operating parameters. Dynamically changing the packet format facilitates tailoring or selection of packets, such that redundant information is not sent between the hearing devices in turn reducing the amount of transmitted data thereby optimizing power consumption.

The first hearing device operating parameter may be a processing parameter of the hearing device, such as a compressor gain, and to determine if the change criterion is fulfilled may comprise determining whether a change in the processing parameter of the hearing device is larger than a change threshold. Thus the change criterion or a subcriterion thereof may be fulfilled if one or more processing parameters changes significantly.

The first hearing device operating parameter may be a parameter indicative of user interface activation, such as push button activation, and to determine if the change criterion is fulfilled may comprise determining whether the user interface has been activated, i.e. the change criterion is fulfilled if the user interface has been activated.

A second hearing device operating parameter may be a parameter indicative of mode shift in the hearing device, and to determine if the change criterion is fulfilled may comprise determining whether a mode shift has occurred in the hearing device, i.e. the change criterion is fulfilled if a mode shift has occurred.

FIG. 1 schematically illustrates an exemplary hearing device 2 with dynamic mirror service as disclosed herein. The hearing device 2 comprises a processing unit 4, a wireless transceiver 6 connected to the processing unit 4, and a receiver 8 connected to the processing unit 4 for converting an output signal into an audio output signal. The wireless transceiver 6 may be part of a user interface, and optionally the hearing device comprises a push button or volume control 9 allowing a user to control operation of the hearing device 2. The hearing device 2 is configured to perform mirror service 10 between the hearing device 2 and another hearing device 14 according to mirror service properties. The hearing device 2 optionally comprises a signal generator 11 and/or an environment classifier 12. The signal generator 11 and/or the environment classifier 12 may form a part of the processing unit 4. The hearing device 2 and the other hearing device 14 may be a first and a second hearing device, respectively, in a binaural hearing device system. The mirror service 10 comprises transmitting mirror service packets with respective packet format at a packet transmission rate. The processing unit 4 is configured to obtain at least the first hearing device operating parameter, e.g. indicative of one or more of user interface activation, mode shift, environment conditions, and/or processing parameter(s) of the hearing device. Based on the first hearing device operating parameter and/or further hearing device operating parameters such as a second hearing device operating parameter, the processing unit 4 is configured to determine if a change criterion is fulfilled. If the change criterion is fulfilled, the processing unit is configured to change the mirror service properties by changing the packet format from a first packet format to a second packet format, and/or changing the packet transmission rate from a first packet transmission rate, e.g. in the range from 0.4 packets/s to 1.1 packets/s, to a second packet transmission rate, e.g. of 12.5 packets/s or about 13.5 packets/s.

Figure 2:
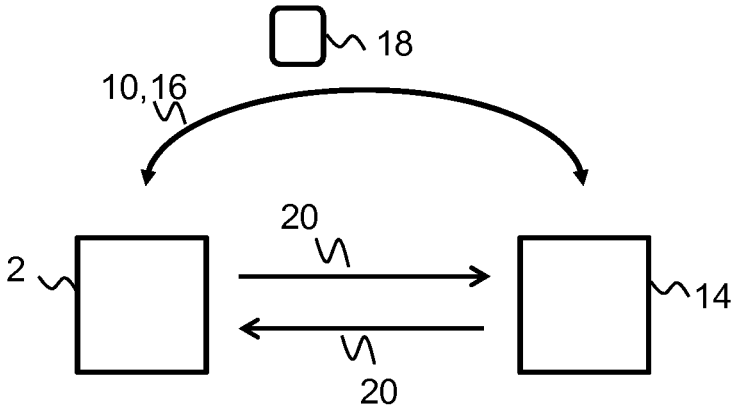
FIG. 2. schematically illustrates an exemplary mirror service between a hearing device and another hearing device, FIG. 3 schematically illustrates exemplary mirror service packets, FIG. 4 schematically illustrates an exemplary flow chart of a method of performing mirror service between two hearing devices.

FIG. 2 schematically illustrates an exemplary mirror service 10 between a hearing device 2 and another hearing device 14. The hearing device 2 transmits (ref 16) mirror service packets 18 at a first packet transmission rate to the other (second) hearing device 14 in a first mode of the mirror service. Then, the processing unit determines that the change criterion is fulfilled, e.g. by a user activating the user interface 9 in the hearing device 2, hearing device operating mode is changed (automatically or invoked by a user), and/or the environment changes (thereby changing the transmission conditions). The processing unit 4 changes the mirror service properties by changing the packet transmission rate from the first packet transmission rate to a second packet transmission rate different from the first packet transmission rate, e.g. larger than the first packet transmission rate if the mirror service must go from sleep mode to active mode and/or if the transmission conditions have worsened. The processing unit 4 changes from the first packet transmission rate to a second packet transmission rate less than the first packet transmission rate, e.g. if evaluation of the change criterion indicates that the mirror service can go from active mode to sleep mode and/or if the transmission conditions have improved. Optionally, the hearing device 2 and the other hearing device 14 exchange audio streams 26 via a separate audio channel.

Figure 3:
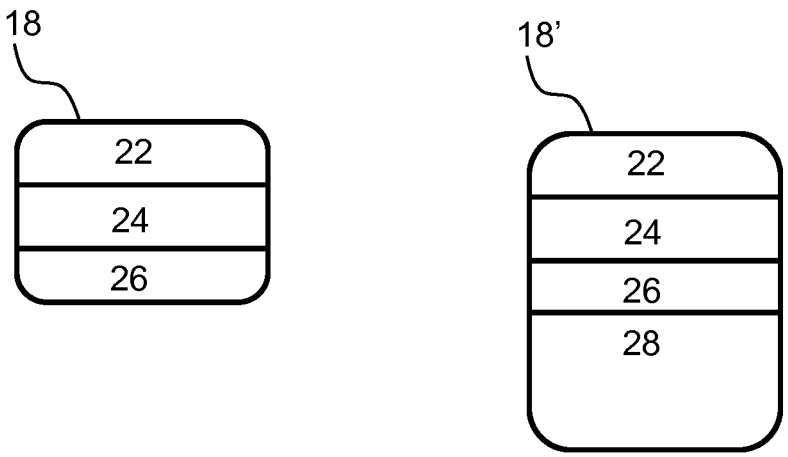

FIG. 3 schematically illustrates an exemplary mirror service packet 18 with a first packet format and an exemplary mirror service packet 18' with a second mirror service packet format. The mirror service packet 18 has a first field 22 being a header field comprising hearing device identifier indicative of the hearing device transmitting the packet 18. A second field 24 of the packet 18 comprises a packet format identifier indicative of the packet type and content of the packet. Further, a third field 26 of the packet 18 comprises data of one or more hearing device operating parameters to be mirrored to the other hearing device 14. For example, a mirror service may be configured to use a plurality of different and predefined packet types. For example, the first packet format as illustrated in FIG. 3 may be used for mirroring changes in operating mode of the hearing device 2. Thus, the packet format identifier in the second field 24 is set to a value (e.g. 1) indicative of mirroring of mode shift, and the third field 26 indicates the actual operating mode of the hearing device, e.g. first mode (third field=1), second mode (third field=2), etc. The mirror service packet 18' has a second packet format different from the first packet format in size and/or field configuration. The mirror service packet 18' has a first field 22 being a header field comprising hearing device identifier indicative of the hearing device transmitting the packet 18, a second field 24, a third field 26 and a fourth field 28. The second field 24 of the packet 18' comprises a packet format identifier indicative of the packet type and content of the packet. Further, a third field 26 and fourth field 28 of the packet 18' comprises data of one or more hearing device operating parameters to be mirrored to the other hearing device 14. For example, the second packet format as illustrated in FIG. 3 may be used for mirroring changes in volume of the hearing device 2. Thus, the packet format identifier in the second field 24 of mirror service packet 18' may be set to a value (e.g. 2) indicative of user interface activation, and the third field 26 indicates that the user has adjusted volume. Further, the fourth field 28 contains data on a hearing device operating parameter, namely the actual volume gain applied in the hearing device as a result of the user interface activation.

Figure 4:
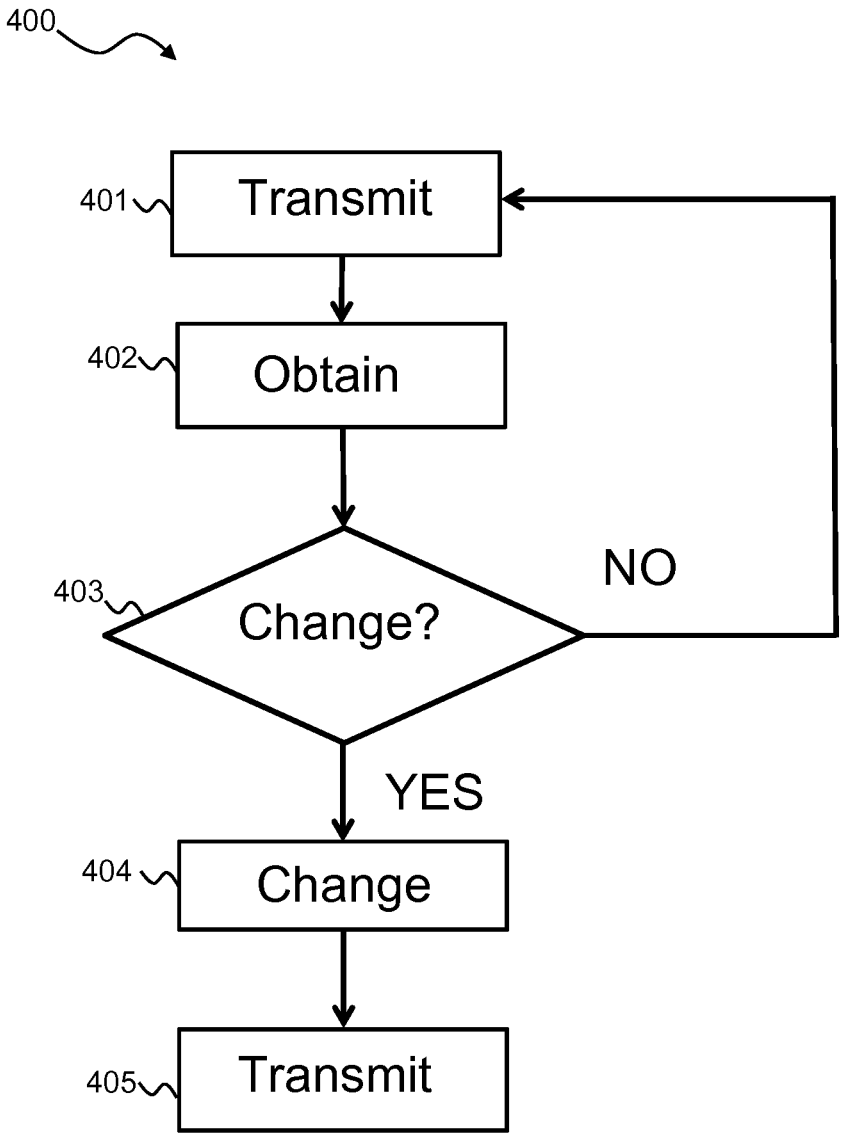

FIG. 4 schematically illustrates an exemplary flow chart of a method of performing mirror service between a first hearing device and a second hearing device. The method 400 comprises transmitting 401 mirror service packets according to mirror service properties (first mirror service properties) with a packet format at a packet transmission rate. The mirror service packet comprises one or more hearing device operating parameters including a first hearing device operating parameter. The method 400 may be performed with a hearing device as disclosed herein and comprises obtaining 402 the first hearing device operating parameter, e.g. with the processing unit 4. The method 400 then proceeds to determining 403 if a change criterion is fulfilled. The change criterion is based at least on the first hearing device operating parameter. If the change criterion is fulfilled, the method proceeds to changing 404 the mirror service properties, such as the packet transmission rate and/or the packet format, and subsequently transmitting 405 mirror service packets according to the changed mirror service properties (second mirror service properties). If the change criterion is not fulfilled in step 403, mirror service packets are transmitted according to the unchanged mirror service properties of step 401.

Also disclosed are hearing devices and methods according to any of the following items:

Item 1. A hearing device comprising:

a processing unit;

a wireless transceiver connected to the processing unit; and a receiver connected to the processing unit for converting an output signal into an audio output signal;

wherein the hearing device is configured to perform mirror service between the hearing device and another hearing device according to one or more mirror service properties, wherein the mirror service comprises transmitting mirror service packets with a packet format at a packet transmission rate; at least one of the mirror service packets comprising one or more hearing device operating parameters including a first hearing device operating parameter, wherein the processing unit is configured to:

obtain the first hearing device operating parameter;

determine if a change criterion is fulfilled, wherein the change criterion is based on the first hearing device operating parameter; and change a mirror service property, if the change criterion is fulfilled.

Item 2. Hearing device according to item 1, wherein the mirror service property comprises a packet transmission rate and/or packet format.

Item 3. Hearing device according to item 2, wherein the processing unit is configured to change the mirror service property by changing the packet transmission rate from a first packet transmission rate to a second packet transmission rate.

Item 4. Hearing device according to item 3, wherein the first packet transmission rate is larger than the second packet transmission rate.

Item 5. Hearing device according to item 3, wherein the second packet transmission rate is larger than the first packet transmission rate.

Item 6. Hearing device according to any of items 1-5, wherein the first hearing device operating parameter is indicative of one or more of a user interface activation, a mode shift, and/or processing parameter(s) of the hearing device.

Item 7. Hearing device according to item 6, wherein the processing parameter(s) of the hearing device comprises one or more of:

environment identifier;

noise reduction parameter;

compressor parameter;

signal generator control; and auto phone detector.

Item 8. Hearing device according to any of items 1-7, wherein the one or more hearing device operating parameters comprises a mirror service identifier.

Item 9. Hearing device according to any of items 1-8 as dependent on item 2, wherein the processing unit is configured to change the mirror service property by changing the packet format from a first packet format to a second packet format.

Item 10. Hearing device according to any of items 1-9, wherein the first hearing device operating parameter comprises a processing parameter of the hearing device; and wherein processing unit is configured to determine if the change criterion is fulfilled by determining whether a change in the processing parameter of the hearing device is larger than a change threshold.

Item 11. A method of performing mirror service between a first hearing device and a second hearing device, the method comprising:

transmitting mirror service packets according to one or more mirror service properties with a packet format at a packet transmission rate, at least one of the mirror service packets comprising one or more hearing device operating parameters including a first hearing device operating parameter;

obtaining the first hearing device operating parameter;

determining if a change criterion is fulfilled, wherein the change criterion is based on the first hearing device operating parameter;

changing a mirror service property, if the change criterion is fulfilled; and transmitting mirror service packets according to the changed mirror service property.

Item 12. Method according to item 11, wherein the act of changing the mirror service properties comprises changing a packet transmission rate and/or packet format Item 13. A binaural hearing device system comprising a first and a second hearing device, wherein the first and/or second hearing device is a hearing device according to any of items 1-10.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

2 hearing device
4 processing unit
6 wireless transceiver
8 receiver
9 push button/volume control
10 mirror service
14 another hearing device
16 transmission of mirror service packets
18 mirror service packet with first packet format
18' mirror service packet with second packet format
20 audio stream
22 first field
24 second field
26 third field
28 fourth field
400 method of performing mirror service
401 transmitting mirror service packets
402 obtaining the first hearing device operating parameter
403 determining if a change criterion is fulfilled
404 changing the mirror service properties
405 transmitting mirror service packets

The invention claimed is:

1. A hearing device comprising:
a processing unit;
a wireless transceiver connected to the processing unit; and
a receiver connected to the processing unit for converting an output signal into an audio output signal;
wherein the hearing device is configured to perform mirror service between the hearing device and an other hearing device according to a mirror service property, wherein the hearing device is configured to perform the mirror service by transmitting mirror service packets to the other hearing device, at least one of the mirror service packets comprising one or more hearing device operating parameters including a first hearing device operating parameter, wherein the processing unit is configured to:
determine whether a time criterion is satisfied; and
change the mirror service property if the time criterion is satisfied; and
wherein the mirror service property comprises a packet transmission rate, and wherein the processing unit is configured to change the mirror service property by changing the packet transmission rate from a first packet transmission rate to a second packet transmission rate; and
wherein the first packet transmission rate is different from zero, and the second packet transmission rate is different from zero.

2. The hearing device according to claim 1, wherein the mirror service property also comprises a packet format.

3. The hearing device according to claim 2, wherein the processing unit is configured to change the mirror service property by changing the packet format from a first packet format to a second packet format.

4. The hearing device according to claim 1, wherein the first packet transmission rate is larger than the second packet transmission rate.

5. The hearing device according to claim 1, wherein the second packet transmission rate is larger than the first packet transmission rate.

6. The hearing device according to claim 1, wherein the first hearing device operating parameter is indicative of a user interface activation, a mode shift, processing parameter(s) of the hearing device, or any combination of the foregoing.

7. The hearing device according to claim 6, wherein the processing parameter(s) of the hearing device comprises an environment identifier, a noise reduction parameter, a compressor parameter, a signal generator control, an auto phone detector, or any combination of the foregoing.

8. The hearing device according to claim 1, wherein the one or more hearing device operating parameters comprises a mirror service identifier.

9. The hearing device according to claim 1, wherein the first hearing device operating parameter comprises a processing parameter of the hearing device; and
wherein the processing unit is configured to determine if a change criterion is fulfilled by determining whether a change in the processing parameter of the hearing device is larger than a threshold.

10. A binaural hearing device system comprising the hearing device according to claim 1, and an additional hearing device.

11. The hearing device according to claim 1, wherein the processing unit is configured to determine whether the time criterion is satisfied based on an amount of time that has passed since a previous change in at least one of the one or more hearing device operating parameters.

12. The hearing device according to claim 1, wherein the processing unit is configured to determine whether the time criterion is satisfied based on an amount of time that has passed since a previous fulfilment of a change criterion.

13. The hearing device according to claim 1, wherein the time criterion comprises a default time, and wherein the processing unit is configured to determine whether the default time is satisfied.

14. The hearing device according to claim 1, wherein the time criterion is a subcriterion of a change criterion.

15. The hearing device according to claim 1, wherein the mirror service comprises a normal mode and an idle mode;
wherein the first packet transmission rate is for the normal mode of the mirror service; and
wherein the second packet transmission rate is for the idle mode of the mirror service.

16. A method of performing mirror service between a first hearing device and a second hearing device, the method comprising:
transmitting mirror service packets according to a mirror service property, at least one of the mirror service packets comprising one or more hearing device operating parameters including a first hearing device operating parameter;
determining whether a time criterion is satisfied; and
changing the mirror service property if the time criterion is satisfied; and
transmitting additional mirror service packets according to the changed mirror service property;
wherein the mirror service property comprises a packet transmission rate, and wherein the act of changing the mirror service property comprises changing the packet transmission rate from a first packet transmission rate to a second packet transmission rate; and
wherein the first packet transmission rate is different from zero, and the second packet transmission rate is different from zero.

17. The method according to claim 16, wherein the act of changing the mirror service property comprises changing a packet transmission rate and/or a packet format.

18. The method according to claim 16, wherein the act of determining whether the time criterion is satisfied is performed based on an amount of time that has passed since a previous change in at least one of the one or more hearing device operating parameters.

19. The method according to claim 16, wherein the act of determining whether the time criterion is satisfied is performed based on an amount of time that has passed since a previous fulfilment of a change criterion.

20. The method according to claim 16, wherein the time criterion comprises a default time, and wherein the act of determining whether the time criterion is satisfied comprises determining whether the default time is satisfied.

21. The method according to claim 16, wherein the time criterion is a subcriterion of a change criterion.

22. the method according to claim 16, wherein the mirror service comprises a normal mode and an idle mode;

wherein the first packet transmission rate is for the normal mode of the mirror service; and wherein the second packet transmission rate is for the idle mode of the mirror service.

23. A hearing device comprising: a processing unit;

a wireless transceiver connected to the processing unit; and a receiver connected to the processing unit for converting an output signal into an audio output signal;

wherein the hearing device is configured to perform mirror service between the hearing device and an other hearing device according to a mirror service property;

wherein the processing unit is configured to determine whether a criterion is satisfied, and change the mirror service property if the criterion is satisfied;

wherein the processing unit is configured to change the mirror service property by changing a packet transmission rate from a first packet transmission rate to a second packet transmission rate; and wherein the mirror service comprises a normal mode and an idle mode, wherein the first packet transmission rate is for the normal mode of the mirror service, and wherein the second packet transmission rate is for the idle mode of the mirror service.

24. The hearing device according to claim 23, wherein the criterion comprises a time criterion, and wherein the processing unit is configured to determine whether the time criterion is satisfied based on an amount of time that has passed since a previous change in one or more hearing device operating parameters.

25. The hearing device according to claim 23, wherein the criterion comprises a time criterion, and wherein the processing unit is configured to determine whether the time criterion is satisfied based on an amount of time that has passed since a previous fulfilment of a change criterion.

26. The hearing device according to claim 23, wherein the criterion comprises a default time, and wherein the processing unit is configured to determine whether the default time is satisfied.

27. The hearing device according to claim 23, wherein the criterion is a time criterion, the time criterion being a subcriterion of a change criterion.

28. The hearing device according to claim 23, wherein the criterion is based on a hearing device operating parameter, the hearing device operating parameter being indicative of a user interface activation, a mode shift, processing parameter(s) of the hearing device, or any combination of the foregoing.

29. The hearing device according to claim 28, wherein the processing parameter(s) of the hearing device comprises an environment identifier, a noise reduction parameter, a compressor parameter, a signal generator control, an auto phone detector, or any combination of the foregoing.

30. The hearing device according to claim 23, wherein the criterion is based on a hearing device operating parameter, the hearing device operating parameter comprising a mirror service identifier.

* * * * *